US006174244B1

(12) United States Patent
Zimmerman

(10) Patent No.: US 6,174,244 B1
(45) Date of Patent: Jan. 16, 2001

(54) GOLF CLUB, KIT USED WITH A GOLF CLUB AND METHOD OF ADJUSTING A GOLF CLUB GRIP

(76) Inventor: John C. Zimmerman, P.O. Box 813, Ft. Walton Beach, FL (US) 32549-0813

( * ) Notice: Under 35 U.S.C. 154(b), the term of this patent shall be extended for 0 days.

(21) Appl. No.: 09/116,524

(22) Filed: Jul. 16, 1998

(51) Int. Cl.[7] ..... A63B 53/14

(52) U.S. Cl. ..... 473/203; 473/298; 473/551; 16/110 R

(58) Field of Search ..... 473/203, 300, 473/301, 303, 551, 549, 298; 16/110 R, 111 R, 114 R

(56) References Cited

U.S. PATENT DOCUMENTS 1,071,344 * 8/1913 Provan ..... 473/300
4,065,127 * 12/1977 Fagan ..... 473/203
4,174,109 * 11/1979 Gaiser ..... 473/549 X
4,785,495 * 11/1988 Dellis ..... 16/111 R
4,836,544 * 6/1989 Lai ..... 473/551
4,934,024 * 6/1990 Sexton, I ..... 16/111 R
5,482,270 * 1/1996 Smith ..... 473/551

* cited by examiner

*Primary Examiner*—Kien T. Nguyen
(74) *Attorney, Agent, or Firm*—Harry C. Post, III

(57) ABSTRACT

A golf club has a head to strike a golf ball and an elongated shaft with first and second ends, the second end being secured to the head. A grip is connected to the first end of the shaft and includes a plurality of shoulders extending away from the shaft and grooves extending between the shoulders. The shoulders are spaced apart from one another by a distance sufficient to receive fingers in the grooves when gripped by a golfer. A kit is used with a golf club. The kit comprises an elongated pad adapted to provide a plurality of shoulders extending away from a shaft of the gulf club and grooves extending between the shoulders. Also in the kit is apparatus that detachably connects the pad to a grip of the golf club. The grip of a golf club is adjusted by supporting a golf club with its head positioned as if to hit a golf ball. A position where the knuckles of the fingers are located when the club is in this position is then located. An elongated strip of two-sided tape is fastened to the grip where the knuckles of the golfer would be located. An elongated pad of thermoplastic material is fastened to the two-sided tape. The thermoplastic material is heated to a moldable temperature.

3 Claims, 1 Drawing Sheet

GOLF CLUB, KIT USED WITH A GOLF CLUB AND METHOD OF ADJUSTING A GOLF CLUB GRIP

BACKGROUND OF THE INVENTION

This invention relates to golfing equipment, a kit used with golfing equipment and a method to obtain improved golfing equipment and, more particularly, to a golf club, a kit used with a golf club and a method of adjusting a golf club grip.

In the game of golf, it is well known that when a golf ball is improperly hit, the ball can hook, slice or merely roll along the ground. In such event, the ball does not carry as far as one desires and the number of strokes increased.

The ball is improperly hit when the hands of the golfer gripping the golf club shaft slips or otherwise moves relative to the shaft as the club is being swung, and when the hands of the golfer gripping the golf club shaft are not properly positioned around the shaft so that the head of the golf club approaches the ball at an improper angle.

Accordingly, it is an object of the present invention to provide a golf club with a grip that assists the golfer in preventing movement of the golfer's hands relative to the golf club shaft as the club is being swung.

Further, it is an object of the present invention to provide a golf club with a grip that assists the golfer in properly aligning the golfer's hands around the golf club shaft so that the head of the golf club is properly maintained as the golf club head strikes the golf ball after the club is swung.

Further, it is an object of the present invention to provide a kit that is used with a golf club that assists the golfer in preventing movement of the golfer's hands relative to the golf club shaft as the club is being swung.

Further, it is an object of the present invention to provide a kit that is used with a golf club that assists the golfer in properly aligning the golfer's hands around the golf club shaft so that the head of the golf club is properly maintained so that the golf club head properly strikes the golf ball after the club is swung.

Further, it is an object of the present invention to provide a method of adjusting the grip on a golf club to each individual golfer so that movement of the hands of the golfer relative to the golf club shaft is prevented.

Further, it is an object of the present invention to provide a method of adjusting the grip on a golf club to each individual golfer so that the head of the golf club is maintained so that the golf club head properly strikes the golf ball after the club is swung.

BRIEF SUMMARY OF THE INVENTION

In accordance with the present invention, there is provided a golf club having a head for striking a golf ball. An elongated shaft has a first end and a second end that is secured to the head. A grip is connected to the first end of the shaft and includes a plurality of shoulders extending away from the shaft and grooves extending between the shoulders. The shoulders are disposed apart from one another by a distance sufficient to receive fingers in the grooves when the grip is gripped by a golfer.

Further, in accordance with the present invention, there is provided a kit that is used with a golf club. The kit comprises an elongated pad adapted to provide a plurality of shoulders extending away from a shaft of the gulf club and grooves extending between the shoulders. The shoulders are disposed apart from one another by a distance sufficient to receive fingers in the grooves when gripped by a golfer. Connecting apparatus is used to detachably connect the pad to a grip of the golf club.

Further, in accordance with the present invention, there is provided a method of adjusting the grip of a golf club. The method comprises the steps of supporting a golf club with its head positioned as if to hit a golf ball. The position on the grip of the club is then located with the knuckles of the fingers being located while the club is positioned. An elongated strip of two-sided tape is fastened to the position where the knuckles of the golfer are to be located. An elongated pad of thermoplastic material is then fastened to the two-sided tape. The thermoplastic material is heated to a moldable temperature. The grip and pad are gripped by the golfer to form shoulders and grooves for the fingers of the individual golfer. The thermoplastic material is then allowed to set.

BRIEF DESCRIPTION OF THE SEVERAL VIEWS OF THE DRAWING

Objects and advantages of the invention will become apparent upon reading the following detailed description and upon reference to the drawings, wherein like reference characters are used throughout to designate like parts.

DETAILED DESCRIPTION OF THE INVENTION

Figure 1:
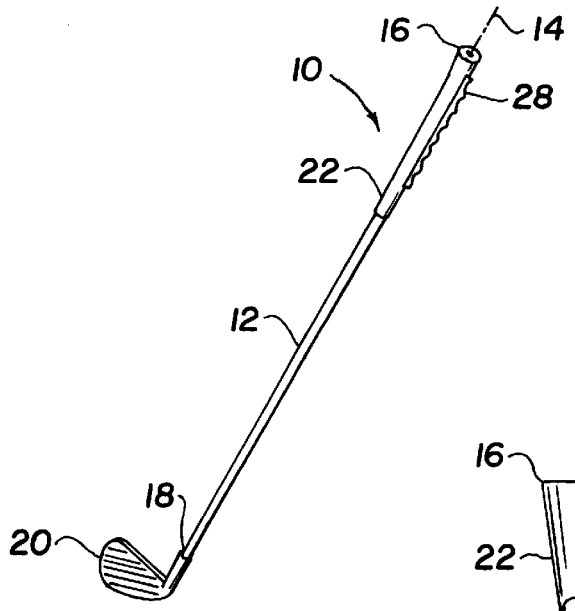
FIG. 1 is a perspective view of a golf club constructed according to the present invention.
Figure 2:
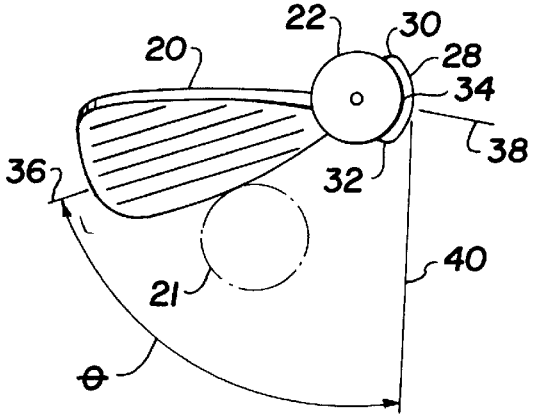
FIG. 2 is an enlarged, end view taken axially along the golf shaft of the golf club shown in FIG. 1.
Figure 4:
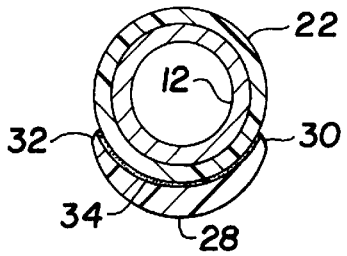
FIG. 4 is an enlarged view taken along lines 4—4 in the direction of the arrows of the golf club shown in FIG. 3.

Turning now to the drawing, there is shown a golf club 10. Club 10 has a conventional elongated shaft 12 with an axis of symmetry 14 extending coincident with its elongated axis and having a first end 16 and a second end 18. A conventional golf club head 20 for hitting a golf ball 21 is attached in a conventional manner to second end 18 of shaft 12 and a conventional grip 22 is connected in a conventional manner to first end 16 of shaft 12. Although golf club 10 is shown as an iron, the invention will operate when the club is an iron, a wood or any other golf club.

Figure 3:
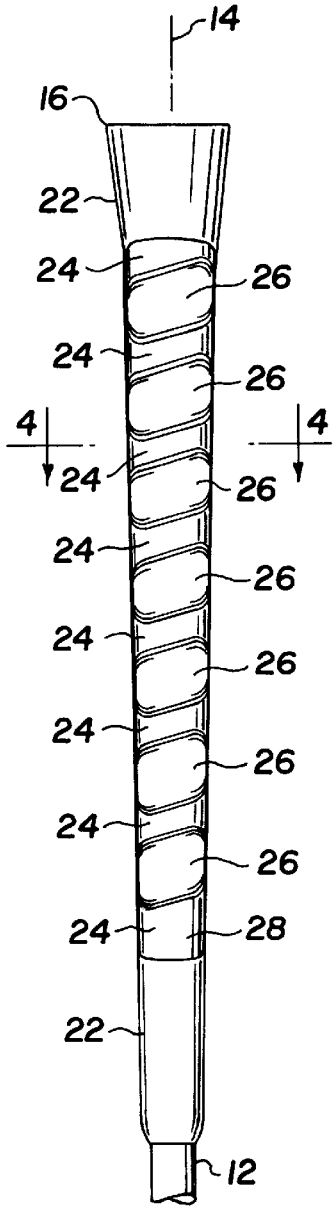
FIG. 3 is an enlarged view of the grip of the golf club shown in FIG. 1.

Disposed along grip 22 from first end 16 of shaft 12 toward second end 18 are a plurality of shoulders 24 that extend outwardly of shaft 12 (away from axis of symmetry 14) and grooves 26 that extend between shoulders 24. Shoulders 24 are disposed apart from one another by a distance sufficient to receive fingers in grooves 26 when grip 22 is gripped by a golfer. It has been determined that a normal golfer requires eight shoulders 24 and seven grooves 26 because the little and first fingers of the left and right hands normally overlap in one of the grooves and these two fingers therefore require only one groove. Also, as clearly shown in FIG. 3, shoulders 24 and grooves 26 are disposed to extend in a generally spiral direction around shaft 12 to provide comfort to the golfer using club 10 and to assist in preventing head 20 from rotating around axis of symmetry 14 relative to the hands of the golfer using club 10.

Shoulders 24 and grooves 26 are provided on an elongated pad 28 that is detachably connected to grip 22 and is disposed to extend from the outer end of grip 22 substantially parallel to the axis of symmetry 14 and along shaft 12 toward second end 18. While connected to grip 22, pad 28 becomes a part of grip 22. Pad 28 has a length sufficient to position all of the fingers of the normal golfer in grooves 28 on pad 24 to prevent an inconsistently sized grip for the normal golfer using the club 10. Also, to prevent discomfort to the normal golfer using club 10, pad 28 has a width sufficient to extend across each knuckle of the fingers of the normal golfer using the club and is tapered so that the fingers of a golfer using club 10 flow over its elongated sides 30 and 32.

It is preferred that elongated pad 28 is made from a thermoplastic material that sets at a temperature above the hottest temperature of the environment in which golf club 10 is to be used. Also, it is preferred that elongated pad 28 is made from a thermoplastic material that is moldable at a temperature chosen to be below a temperature that would burn a golfer. It is more preferred that elongated pad 28 is made from a thermoplastic material that is moldable at a temperature chosen to be below a temperature that would burn a golfer and sets at a temperature above the hottest temperature of the environment in which the golf club is to be used. It is preferred that elongated pad 28 is made from a thermoplastic material that sets at a temperature of about 125° F. and becomes moldable at a temperature of about 212° F. It is most preferred, however, that elongated pad 28 be made from a thermoplastic material that sets at a temperature of about 140° F. and becomes moldable at a temperature of about 200° F. A thermoplastic material has been discovered and is disclosed in U.S. Pat. No. 3,734,979, to Koles, which is a discloses a material used in making a mouth guard. The thermoplastic material taught in this patent comprises an ethylene/vinyl acetate copolymer and a thermoplastic polycarprolactone having a molecular weight of 10,000–100,000, optionally with polyvinyl acetate, colorants and perfumes.

Detachable connecting apparatus 34 is used to detachably connect pad 28 to grip 22 connected to shaft 12. It is preferred that connecting apparatus 34 is a conventional two-sided adhesive tape to permit easy connection and disconnection for adjustment of pad 24 radially around shaft 12 so that pad 24 may be properly positioned for the hands of each individual golfer using club 10. If desired, after pad 28 is properly positioned on shaft 12, it may be more securely attached by additional connecting apparatus, such as that obtained by using conventional single-sided adhesive or friction tape. Alternatively, pad 28 may be permanently attached, after its proper position has been determined, by glue or other adhesive.

To adjust the grip of golf club 10, shaft 12 is rotated relative to the support of golf ball 21 and head 20 positioned as when hitting golf ball 21 at the angle of attack for the selected golf club. A line 36 is then drawn radially of axis of symmetry 24 to extend generally along head 20. Another line 38 is then drawn radially of axis of symmetry 24 to extend generally through where pad 28 is bisected. A tangent line 40 is then drawn from the outer surface of pad 28 with an angle Θ being formed between lines 36 and 40. The position on grip 22 is located where the knuckles of the fingers of the golfer are properly positioned on club 10 while head 20 is held at angle Θ in this position. An elongated strip of two-sided adhesive tape 34 is fastened at the position where the knuckles of the golfer should be located. Elongated pad 28 of thermoplastic material is then fastened to two-sided tape 34. The thermoplastic material in pad 28 is heated to its moldable temperature. While at the moldable temperature, grip 22 and pad 28 are grasped by the golfer to form shoulders 24 and grooves 26 for his fingers. While being grasped, the thermoplastic material of pad 28 is allowed to set. Thus, shoulders 24 and grooves 26 are formed in a spiral direction toward head 20 around shaft 12 for use by the individual golfer using club 10. Pad 28 is then secured to grip 22.

To insure a proper grip by the golfer, individual golfer hits golf ball 21 with club 10. If the golfer is not satisfied that pad 28 is properly positioned on club 10, then pad 28 is re-positioned or adjusted by removing elongated pad 28 and two-sided adhesive tape 34 from club 10. A new or corrected position (a new angle Θ) is determined or located radially around grip 22 of club 10 to the position that the golfer selects the knuckles of his fingers are to be re-located. Elongated strip of two-sided tape 34 and elongated pad 28 of thermoplastic material are then re-fastened to club 10. The golfer again hits golf ball 21 with club 10 to test the positioning of pad 28 relative to shaft 12 for the individual golfer. If the golfer is still not satisfied, then the previous steps are repeated to reposition pad 28 until he is satisfied. After the golfer is satisfied that pad 28 is properly positioned, pad 28 may be more securely fastened to grip 22 as with additional tape.

If desired, a new grip may be formed with elongated pad 28 incorporated therein and the new grip rotated around symmetrical axis 14 of shaft 12 until the golfer is satisfied.

The invention having been described, what is claimed is:

1. A method of adjusting the grip of a golf club, comprising the steps of: supporting a golf club with its head positioned as if to hit a golf ball; locating the position on the grip of the club where the knuckles of the fingers are located when the club is thus positioned; fastening an elongated strip of two-sided tape along the position where the knuckles of the golfer would be located; fastening an elongated pad of thermoplastic material to the two-sided tape; heating the thermoplastic material to a moldable temperature; grasping the grip and pad to form shoulders and grooves for the fingers of the golfer; and allowing the thermoplastic material to set.

2. A method as set forth in claim 1, comprising the steps of: hitting a golf ball with the club; and, if necessary, adjusting the club by removing the elongated pad of thermoplastic material and the two-sided tape from the club; locating a corrected position radially around the grip of the club where the knuckles of the fingers are to be re-located; and fastening the elongated strip of two-sided tape and the elongated pad of thermoplastic material to the club.

3. A method of adjusting the grip of a golf club, comprising the steps of: supporting a golf club with its head positioned as if to hit a golf ball; locating the position on the grip of the club where the knuckles of the fingers are located when the club is thus positioned; heating an elongated pad of thermoplastic material to a moldable temperature; placing the thermoplastic material where the knuckles of the golfer would be located; grasping the grip and pad to form shoulders and grooves for the fingers of the golfer; allowing the thermoplastic material to set; fastening an elongated strip of two-sided tape at the position on the golf club where the knuckles of the golfer would be located; and fastening the elongated pad of thermoplastic material to the tape.

* * * * *